US011289260B2

(12) United States Patent
Frisvold

(10) Patent No.: US 11,289,260 B2
(45) Date of Patent: Mar. 29, 2022

(54) LOW EMI TRANSFORMATOR AND LOW EMI ELECTRIC CABLE

(71) Applicant: Ezone Green Energy AS, Fornebu (NO)

(72) Inventor: Erlend Frisvold, Stavanger (NO)

(73) Assignee: Ezone Green Energy AS, Fornebu (NO)

( * ) Notice: Subject to any disclaimer, the term of this patent is extended or adjusted under 35 U.S.C. 154(b) by 118 days.

(21) Appl. No.: 16/631,058

(22) PCT Filed: Jun. 15, 2018

(86) PCT No.: PCT/NO2018/050158
§ 371 (c)(1),
(2) Date: Jan. 14, 2020

(87) PCT Pub. No.: WO2019/013642
PCT Pub. Date: Jan. 17, 2019

(65) Prior Publication Data

US 2020/0152366 A1 May 14, 2020

(30) Foreign Application Priority Data

Jul. 14, 2017 (EP) ..... 17181437

(51) Int. Cl.
*H01F 27/28* (2006.01)
*H01F 19/08* (2006.01)
(Continued)

(52) U.S. Cl.
CPC ..... *H01F 19/08* (2013.01); *H01F 27/28* (2013.01); *H01F 27/288* (2013.01);
(Continued)

(58) Field of Classification Search
CPC ..... H01F 19/08; H01F 27/2885; H01F 27/38; H01F 27/42; H01F 2019/085; H01F 27/28; H01F 27/288
See application file for complete search history.

(56) References Cited

U.S. PATENT DOCUMENTS 3,156,914 A 11/1964 Welti
4,660,014 A * 4/1987 Wenaas ..... H01F 27/362 336/84 C
(Continued)

OTHER PUBLICATIONS

International Search Report and the Written Opinion for PCT/NO2018/050158, dated Sep. 27, 2018.
European Search Report for EP 17181437.9, dated Jan. 17, 2018.

*Primary Examiner* — Tuyen T Nguyen
(74) *Attorney, Agent, or Firm* — Andrus Intellectual Property Law, LLP

(57) ABSTRACT

An isolation transformer includes: a Faraday cage and an input ground terminal for connecting to the Faraday cage; and an output ground terminal connected to the Faraday cage for further connection to a further circuit. The isolation trans-former further has a clean ground input terminal for receiving an external clean ground; a clean ground output terminal for connecting to a further clean ground input terminal of the further circuit; and a physical electrical node placed at a location within the Faraday cage where the magnetic flux and electric field are the lowest. The clean ground input terminal is electrically fed into the isolation transformer and connected to the physical electrical node through a first electric connection, and the physical electrical node is further electrically connected to a clean ground output terminal through a second electric connection. The invention provides for a low-EMI isolation transformer.

15 Claims, 11 Drawing Sheets

(51) Int. Cl.
*H01F 27/38* (2006.01)
*H01F 27/42* (2006.01)

(52) U.S. Cl.
CPC ..... *H01F 27/2885* (2013.01); *H01F 27/38* (2013.01); *H01F 27/42* (2013.01)

(56) References Cited

U.S. PATENT DOCUMENTS

| | | | | |
|---|---|---|---|---|
| 8,836,160 | B1 * | 9/2014 | Paterson | H01F 27/02 307/9.1 |
| 9,812,249 | B2 * | 11/2017 | Paterson | H01F 27/06 |
| 2015/0048916 | A1 | 2/2015 | Powell | |

* cited by examiner

LOW EMI TRANSFORMATOR AND LOW EMI ELECTRIC CABLE

CROSS-REFERENCE TO RELATED APPLICATIONS

This application is the U.S. national stage application of International Application PCT/NO2018/050158, filed Jun. 15, 2018, which international application was published on Jan. 17, 2019, as International Publication WO 2019/013642 in the English language. The International Application claims priority of European Patent Application No. 17181437.9, filed Jul. 14, 2017. The international application and European application are both incorporated herein by reference, in entirety.

FIELD OF THE INVENTION

The invention relates to an isolation transformer comprising: i) a Faraday cage comprising a magnetic core and at least one primary coil and at least one secondary coil; ii) input terminals connected to the at least one primary coil via input wires; iii) output terminals connected to the at least one secondary coil via output wires, and iv) an input ground terminal for connecting to the Faraday cage.

BACKGROUND OF THE INVENTION

Isolation transformers block transmission of the DC components in signals from one circuit to the other, while allowing AC components in signals to pass. Transformers that have a ratio of 1 to 1 between the primary and secondary windings are often used to protect secondary circuits and individuals from electrical shocks between energized conductors and earth ground. Suitably designed isolation transformers block interference caused by ground loops. Isolation transformers with electrostatic shields are used for power supplies for sensitive equipment such as computers, medical devices, or laboratory instruments.

Faraday cages are typically used for blocking electrical fields. An external electrical field causes the electric charges within conducting material (which the cage comprises) to be distributed such that they cancel the field's effect in the interior of the cage. This phenomenon is used to protect sensitive electronic equipment within the cage from external radio frequency interference (RFI). Faraday cages are also used to enclose devices that produce RFI themselves, such as radio transmitters. The Faraday cage then prevents the radio waves from interfering with other nearby equipment outside the respective cage. In the case of varying electromagnetic fields, it applies that the faster the variations are (i.e., the higher the frequencies), the better the material resists magnetic field penetration. In such case the shielding also depends on the electrical conductivity, the magnetic properties of the conductive materials used in the cages, as well as their thicknesses.

The problem with the above-mentioned known isolation transformers is that they still suffer from a lot of EMI when used in accordance with the international standards for connecting isolation transformers. The noise levels can even be an order of magnitude higher than the prescribed maximum allowable levels. Thus, there is a clear need for a further improvement of isolation transformers. The most relevant international standard is "2011 NEC" which refers to the UL, CSA and NEMA standards (NEMA ST-20).

SUMMARY OF THE INVENTION

The invention has for its object to remedy or to reduce at least one of the drawbacks of the prior art, or at least provide a useful alternative to prior art.

The object is achieved through features, which are specified in the description below and in the claims that follow.

The invention is defined by the independent patent claims. The dependent claims define advantageous embodiments of the invention.

In a first aspect the invention relates to an isolation transformer comprising: i) a Faraday cage comprising a magnetic core and at least one primary coil and at least one secondary coil; ii) input terminals connected to the at least one primary coil via input wires; iii) output terminals connected to the at least one secondary coil via output wires, iv) and an input ground terminal for connecting to the Faraday cage and an output ground terminal connected to the Faraday cage for further connection to a further circuit to be connected to the isolation transformer. The isolation transformer of the invention further comprises: v) a clean ground input terminal for receiving an external clean ground; vi) a clean ground output terminal for connecting to a further clean ground input terminal of the further circuit, and vii) a physical electrical node placed at a location within the Faraday cage where the magnetic flux and electric field are the lowest, preferably close to zero. The clean ground input terminal is electrically fed into the isolation transformer and connected to the physical electrical node through a first electric connection. Furthermore, the physical electrical node is further electrically connected to a clean ground output terminal through a second electric connection.

In order to facilitate understanding of the invention one or more expressions, used throughout this specification, are further defined hereinafter.

Wherever the wording "coil" is used, this is to be interpreted to be a winding (at least one) of a conductor formed such that an induction is formed.

Whenever the wording "Faraday cage" is used, this is to be interpreted as an enclosure used to block electromagnetic fields. A Faraday shield may be formed by a continuous covering of conductive material or in the case of a Faraday cage, by a mesh of such materials. Faraday cages are named after the English scientist Michael Faraday, who invented them in 1836.

The effects of the method in accordance with the invention are as follows.

An important feature of the invention is that the transformer is provided with a separate (extra) input terminal for receiving a clean ground and a separate (extra) output terminal for supplying a clean ground to the further circuit, whereas in the prior art solutions all grounds are connected to each other, i.e. there is no separate low-EMI ground. In the invention the (normal) input ground terminal is connected to the Faraday cage, which maybe further connected to other Faraday cages of other circuitry, which as such is also the case for the prior art solutions. The clean ground input terminal is fed to a physical electrical node, from which it is further fed towards the clean ground output terminal. The inventors discovered that the placement of this physical electrical node is very critical, i.e. that it must be placed where there is the least magnetic flux and the lowest electric field. Furthermore, the ideal position of the physical electrical node is also dependent on the load of the transformer in that the load determines the internally created electric and magnetic fields. Furthermore, the clean ground output terminal is, in operational use, fed to a further clean ground input of the further circuit. The first electric connection and the second electric connection are preferably placed such that EMI generation is minimized in these connections, for example by using shielded wires and by making the wires run parallel with other signal carrying conductors. In addition, the first and second electric connections must have a low-impedance, not only at low frequencies, but also at high frequencies. By taking these technical measures the transformer of the invention provides for a transformer where EMI that is generated in the further circuit will be fed back to the transformer through the low-impedance clean ground connection instead of through the high-impedance ground connections which creates a lot of noise in the supply voltage of the further circuit, but also in the circuitry and components connected to the further circuit.

The consequence of the combination of the above-mentioned features is an isolation transformer that is much less susceptible to EMI than the isolation transformers as known from the prior art. It must be noted, however, that the invention requires an adaptation of the international standards for connecting isolation transformers. A few of the problems in the 2011 NEC standard are discussed below.

1. The 2011 NEC standard defines the system bonding jumper as "the connection between the grounded circuit conductor and the supply side bonding jumper, or the equipment grounding conductor, or both, at a separately derived system." The objective of the system bonding jumper is to connect the grounded conductor (neutral), supply-side bonding jumper, and the equipment grounding conductors of the separately derived system/transformer, which is required to create an effective ground-fault current path. The problem, however, is that this objective is not achieved, because the ground-fault current path has a too high impedance in many applications, as will be explained later in this application.

The grounding technique as proposed in this invention is one of the key elements that forms an effective ground-fault current path from the furthermost downstream point in the electrical system back to the derived source, the secondary winding of the transformer. If the system ground is not properly installed, an effective ground-fault current path will not be established. This invention sets the standard that should be followed for every transformer.

2. The 2011 NEC standard defines grounding electrode as "a conducting object through which a direct connection to earth is established," and the grounding electrode conductor as "a conductor used to connect the system grounded conductor or the equipment to a grounding electrode or to a point on the grounding electrode system." The purposes of the grounding electrode and grounding electrode conductor is to connect the separately derived system/transformer grounded conductor or equipment to ground (earth), to limit the voltage imposed by line surges and to stabilize the transformer secondary voltage to ground during normal operation. The grounding in the current invention prevents objectionable current flow. The inventor realized that the grounding electrode conductor connection to the grounded conductor should actually be made at the same point on the separately derived system where the system-bonding jumper and supply-side bonding jumper are connected. In addition, it should be connected outside the Faraday cage.

3. The 2011 NEC standard defines supply-side bonding jumper as "a conductor installed on the supply side of a service or within a service equipment enclosure(s), or for a separately derived system, that ensures the required electrical conductivity between the metal parts required to be electrically connected." Specific to this article, the supply-side bonding jumper is the conductor of the wire type, run with the derived circuit conductors from the source/transformer enclosure to the first system disconnecting means. The objective of the supply-side bonding jumper is to connect the equipment grounding conductors of the transformer-derived source to the system bonding jumper/equipment grounding conductor connection, which is required to create an effective ground-fault current path. The inventor realized that if a ground fault occurs on the derived ungrounded circuit conductors, ground-fault current will flow from the point of the ground fault on the derived ungrounded circuit conductors to the system bonding jumper/equipment grounding conductor connection by means of the supply-side bonding jumper to the derived source and then back to the origin of the fault. This unintentional ground-fault current flow elevates the current in the transformer primary overcurrent protection device for ground faults between the derived source of the transformer and the first overcurrent protection device or it facilitates the operation of the transformer secondary overcurrent protection device if the ground fault is on the load side of these devices. The current invention provides for the correct technology for total EMC control.

In an embodiment of the isolation transformer in accordance with the invention the second electric connection comprises a twisted-pair shielded cable, wherein both wires of said cable are connected both to the physical electrical node and to the clean ground output terminal. The effect of using the twisted-pair shielded cable is that EMI that is generated inside the isolation transformer is reduced. More details on the twisted-pair shielded cable are given in the detailed description of the figures.

In an embodiment of the isolation transformer in accordance with the invention the twisted-pair shielded cable is placed such that it runs substantially parallel over a certain length with signal carrying wires, such as the output wires connected between the at least one secondary coil and the output terminals. The effect of placing the twisted-pair shielded cable in this way is that EMI that is generated inside the isolation transformed is reduced. More details on the twisted-pair shielded cable are given in the detailed description of the figures.

In an embodiment of the isolation transformer in accordance with the invention the output wires comprise a twisted-core shielded cable, wherein all output signals are intertwined within the shielded cable for reducing EMI. The effect of using the twisted-core shielded cable is that EMI that is generated inside the isolation transformer is reduced. More details on the twisted-core shielded cable are given in the detailed description of the figures.

In an embodiment of the isolation transformer in accordance with the invention the twisted-pair shielded cable for the clean ground and the twisted-core shielded cable for the output signals are, at least over a certain length, combined into a multi-core shielded cable comprising the shields of said shielded cables with their twisted wires inside of them. The advantage of combining said cables is that it becomes much easier to ensure that said wires are running parallel. More details on the combined twisted-core shielded cable are given in the detailed description of the figures.

In an embodiment of the isolation transformer in accordance with the invention the location of the physical electrical node within the Faraday cage is adjustable for minimizing noise on the output terminals. As the electric and magnetic fields generated inside the Faraday cage of the isolation transformer are dependent on many different parameters and factors, it may be challenging to find the best location for the physical electrical node. This embodiment conveniently allows for the adjustment of this location of the physical electrical node, in at least a first dimension (X), but in a further embodiment also in a second dimension (Y), and in yet a further embodiment in a third dimension (Z). The adjustment of the location of the physical electrical node may also be called calibration of the isolation transformer.

In an embodiment of the isolation transformer in accordance with the invention the isolation transformer is provided with a sensor for sensing the noise on the output terminals, in operational use, and the isolation transformer is configured for automatically adjusting, in operational use, the location of the physical electrical node in response to the sensed noise on the output terminals. The advantage of this embodiment is that it can dynamically adjust the EMI sensitivity by monitoring the noise and automatically adjusting the location of the physical electrical node (for example using actuators for manipulating the location of the physical electrical node).

In an embodiment of the isolation transformer in accordance with the invention at least two separated electrostatic shields are placed in between each pair of primary coil and corresponding secondary coil. The advantage of placing two electrostatic shields (galvanically isolated from each other) in between the primary coil and the secondary coil is that this opens up for the possibility of placing the physical electrical node in between the primary coil and the secondary coil.

In an embodiment of the isolation transformer in accordance with the invention the physical electrical node is formed in between one of the at least one primary coil and the corresponding secondary coil, in between the electrostatic shields and outside the magnetic core. This embodiment forms a first option for placing the physical electrical node.

In an embodiment of the isolation transformer in accordance with the invention the physical electrical node comprises a conductor, such as a 40%-60% silver-copper alloy, that is mounted on the magnetic core via a dielectric barrier, such as Teflon®. This silver-copper alloy has a low surface resistance, which is advantageous for the performance of the isolation transformed and can also be used in other embodiments where the physical electrical node is located elsewhere in the isolation transformer.

In an embodiment of the isolation transformer in accordance with the invention the physical electrical node is formed in a further Faraday cage formed inside the isolation transformer. This embodiment forms a second option for placing the physical electrical node. There are many ways to build a further Faraday cage inside the isolation transformer, for example by implementing a Faraday shield inside the Faraday cage at one side of the magnetic core with the coils such that part of the original Faraday cage is shielded from fields generated in said Faraday cage, thus effectively forming the further Faraday cage therein. The physical electrical node can then be placed inside that further Faraday cage. It must be stressed, however, that there are many alternative ways of forming the further Faraday cage.

In an embodiment of the isolation transformer in accordance with the invention the magnetic core comprises a five-limb magnetic core. A five-limb magnetic core is often used for a 3-phase isolation transformer, wherein three of said five limbs have a primary coil and a secondary coil.

An embodiment of the isolation transformer in accordance with the invention comprises two primary coils and two secondary coils, wherein the input terminals receive at least two input phase signals in operational use, and wherein the output terminals generate at least two output phase signals in operational use. This embodiment forms a typical one-phase isolation transformer (it has actually two phases as discussed in the figure description).

An embodiment of the isolation transformer in accordance with the invention comprises three primary coils and three secondary coils, and wherein the input terminals receive at least three phase signals in operational use, and wherein the output terminals generate at least three phase signals in operational use. This embodiment forms a three-phase isolation transformer.

In an embodiment of the isolation transformer in accordance with the invention the input ground terminal is connected to a terminal of the at least one primary coil. This embodiment forms an isolation transformer with a ground. The primary coils could be connected to form a star network with respect to the (common) ground.

BRIEF INTRODUCTION OF THE DRAWINGS

In the following is described examples of embodiments illustrated in the accompanying drawings, wherein:

FIGS. 1*a*-1*c* show three different types of transformers;

FIG. 2*a* shows a schematic of an isolation transformer;

FIG. 2*b* illustrates a problem that often occurs in isolation transformers;

Figure 1A:
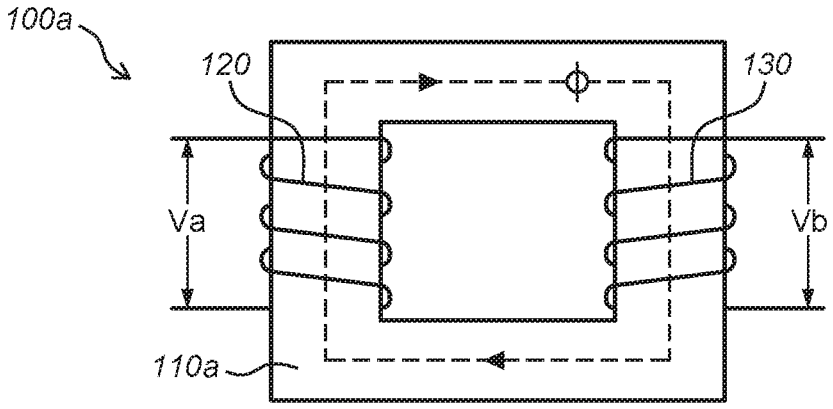
Figure 1B:
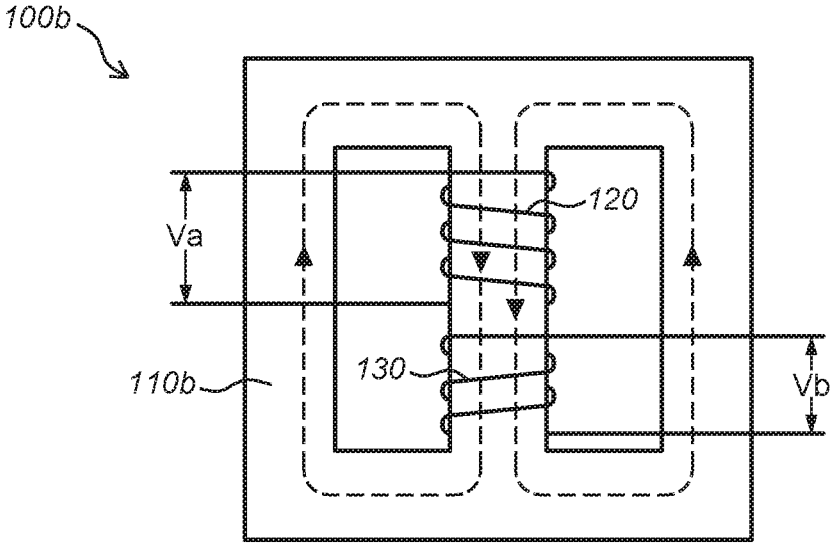
Figure 1C:
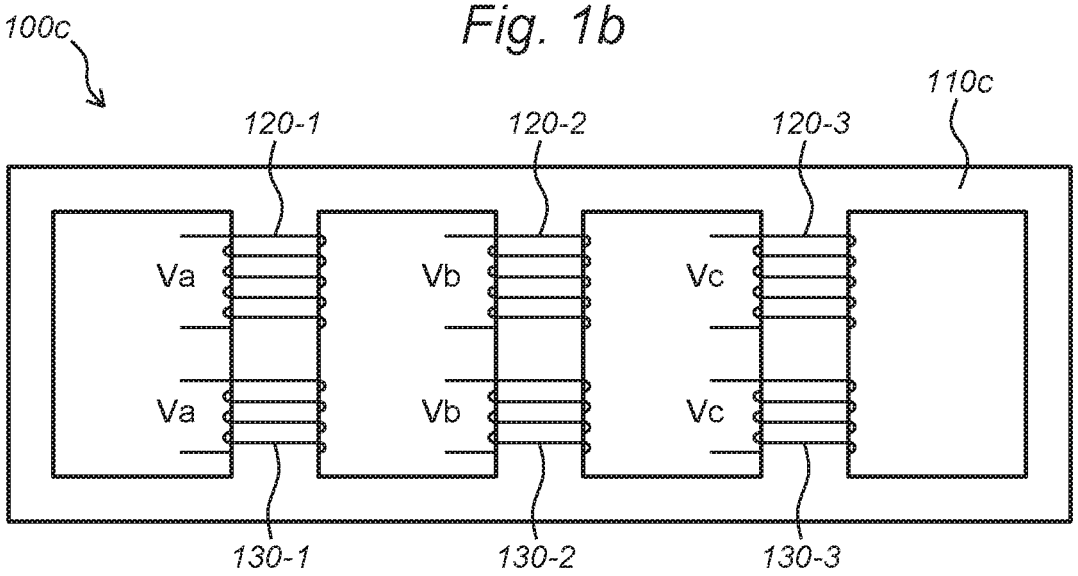
Figure 6A:
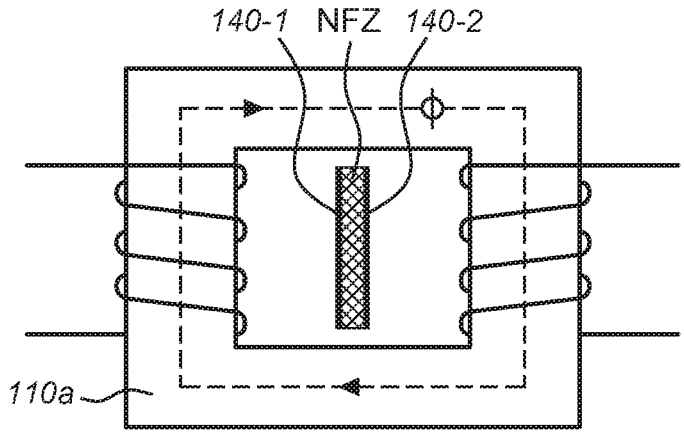
Figure 6B:
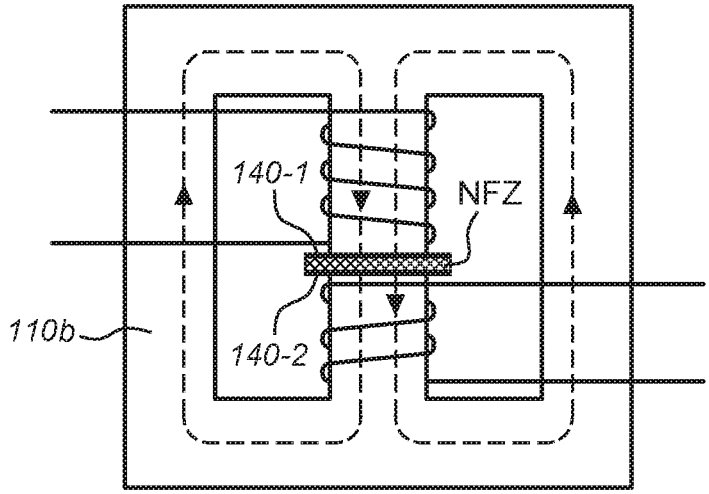
Figure 6C:
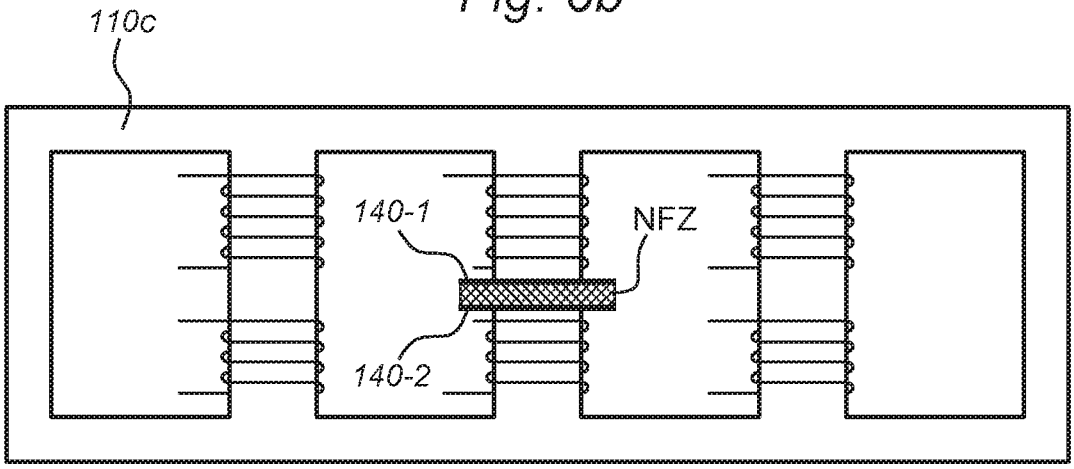

FIGS. 6*a*-6*c* illustrate possible no-field zones in the examples of FIGS. 1*a*-1*c;*

Figure 7:
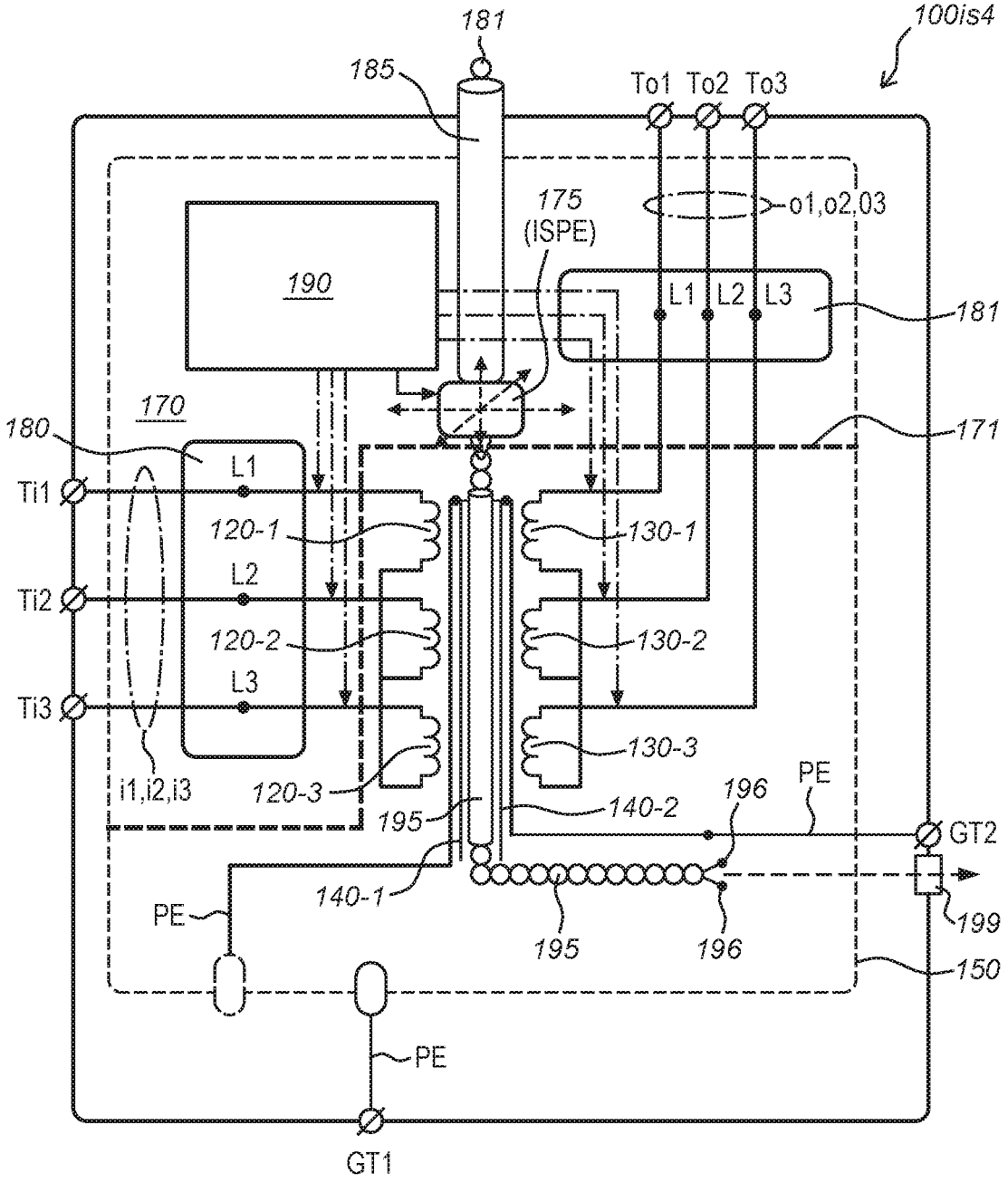
Figure 8A:
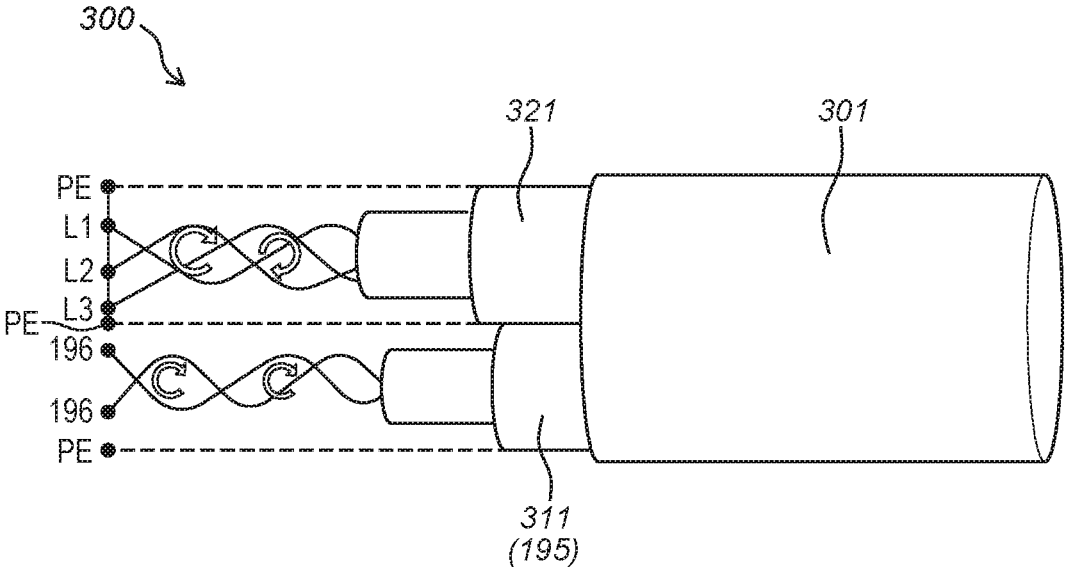
Figure 8B:
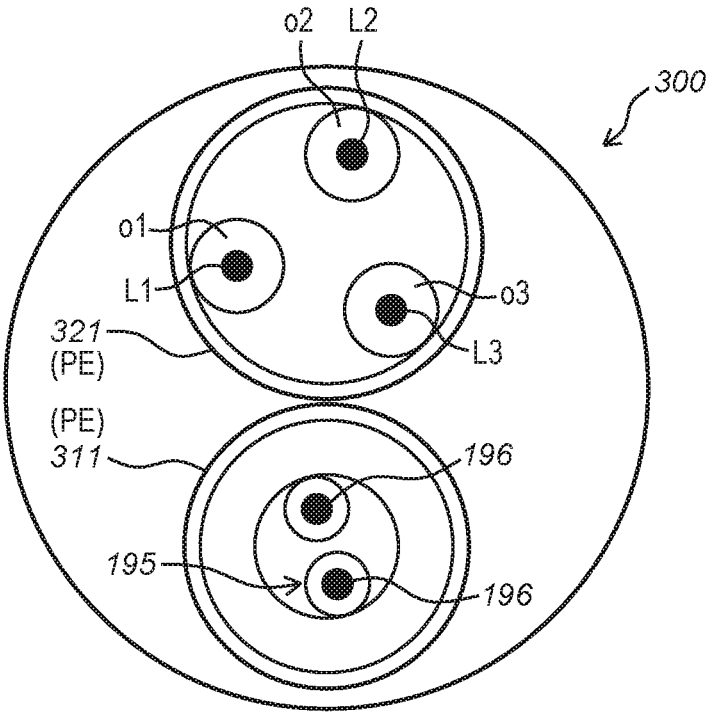
Figure 9:
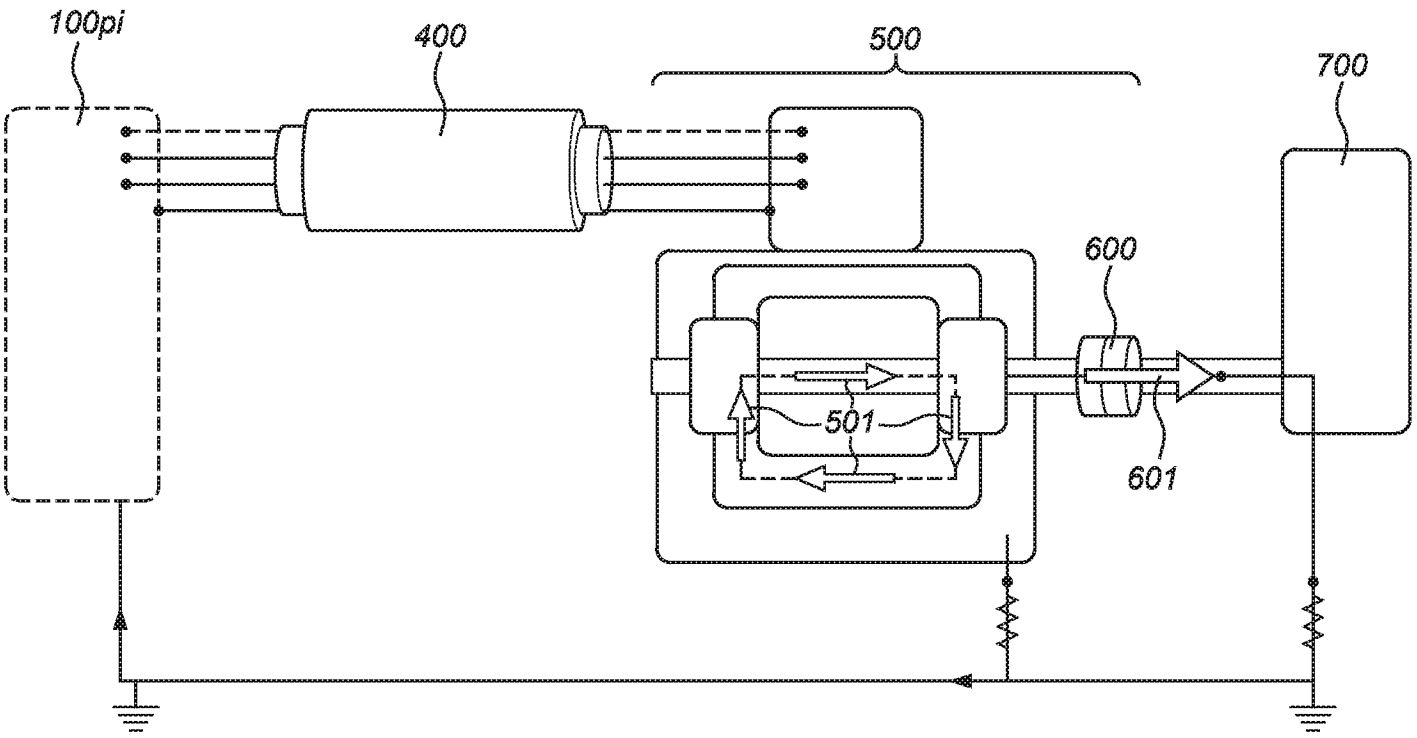
Figure 10A:
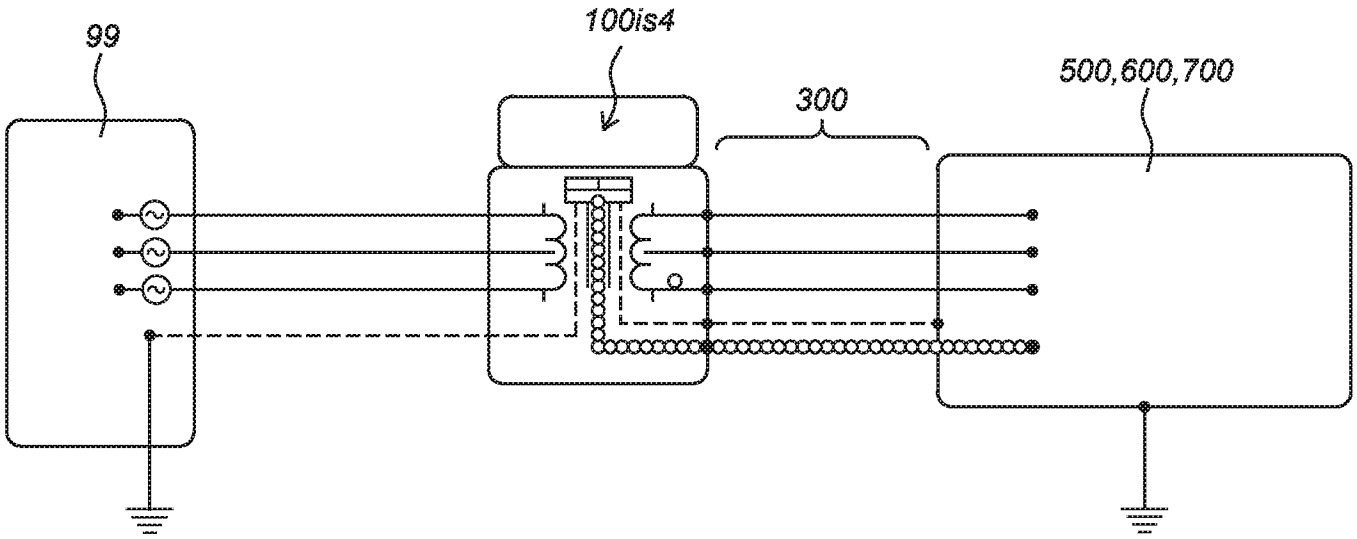
Figure 10B:
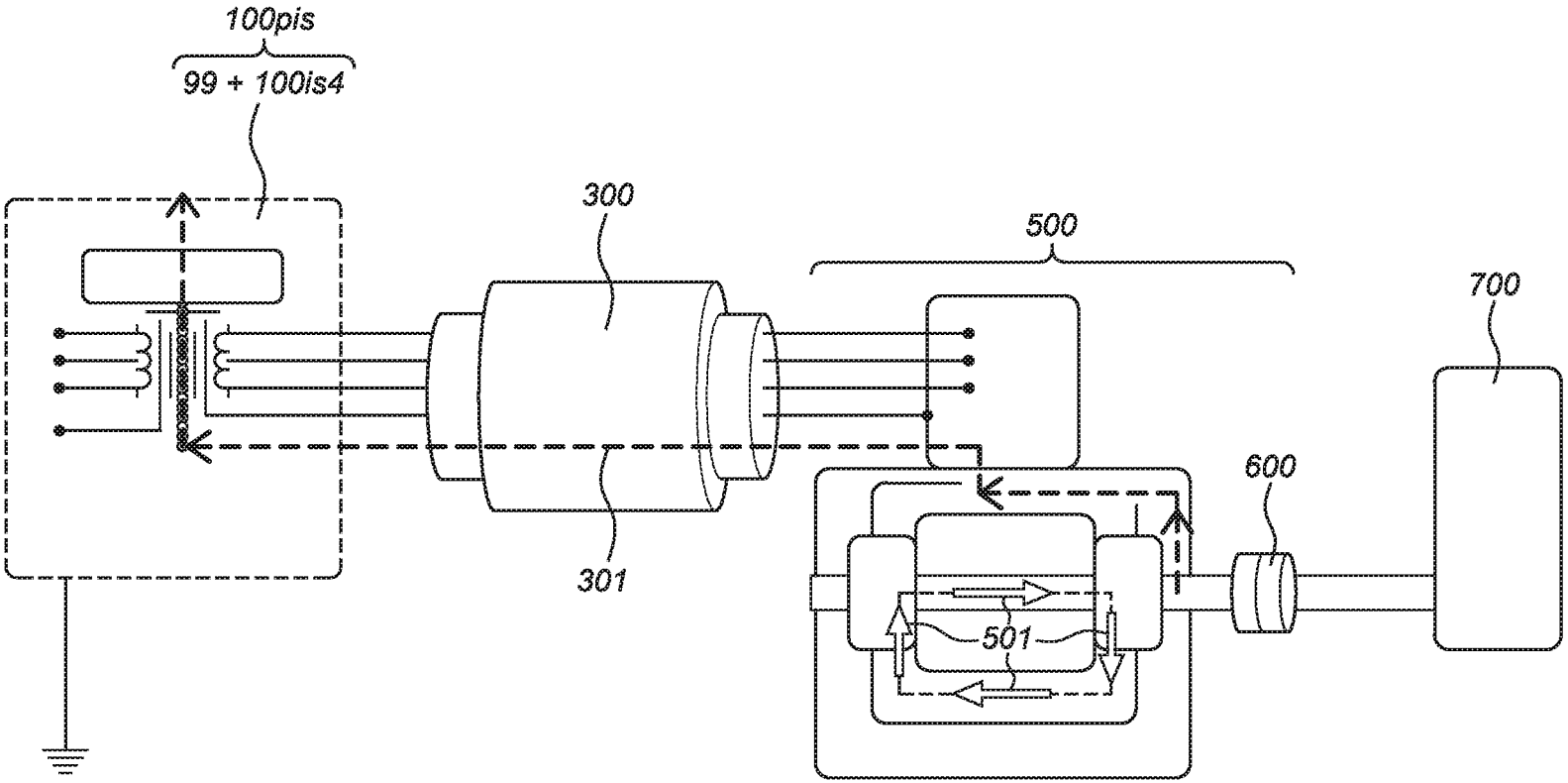

FIG. 7 shows a more detailed schematic of a fourth embodiment of the isolation transformer in accordance with the invention;

FIGS. 8*a*-8*b* show a multi-core shielded cable in accordance with a further embodiment of the invention;

FIG. 9 shows a problem that may occur in isolation transformers of the prior art;

FIG. 10*a* shows the same application as FIG. 9*a*, but now using an isolation transformer in accordance with the invention; and FIG. 10*b* shows how the isolation transformer of the invention solves the problem that occurs in FIG. 9*b*.

DETAILED DESCRIPTION OF THE EMBODIMENTS

Various illustrative embodiments of the present subject matter are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming. Nevertheless it would be a routine undertaking for those of ordinary skill in the art having the benefit of this disclosure.

The present subject matter will now be described with reference to the attached figures. Various systems, structures and devices are schematically depicted in the drawings for purposes of explanation only and so as not to obscure the present disclosure with details that are well known to those skilled in the art. Nevertheless, the attached drawings are included to describe and explain illustrative examples of the present disclosure. The words and phrases used herein should be understood and interpreted to have a meaning consistent with the understanding of those words and phrases by those skilled in the relevant art. No special definition of a term or phrase, i.e. a definition that is different from the ordinary and customary meaning as understood by those skilled in the art, is intended to be implied by consistent usage of the term or phrase herein. To the extent that a term or phrase is intended to have a special meaning, i.e. a meaning other than that understood by skilled artisans, such a special definition will be expressly set forth in the specification in a definitional manner that directly and unequivocally provides the special definition for the term or phrase.

FIGS. 1*a*-1*c* show three different types of transformers. The transformer in FIG. 1*a* is a 1-phase (it is commonly called 1-phase, but it is actually two phases) transformer 100*a* with an O-shaped core 110*a*. The O-shaped core 110*a* is for guiding the magnetic flux $\phi$ from a primary coil 120 to a secondary coil 130 and vice versa as illustrated. The primary coil 120 and the secondary coil 130 are each provided around a respective leg of the O-shaped core 110*a*. The potential difference between the two input phases is called the input voltage Va and the potential difference between the two output phases is called the output voltage Vb.

FIG. 1*b* shows a different 1-phase transformer 100*b* with a so-called three-limb core 110*b*. Both the primary coil 120 and the secondary coil 130 are provided around the middle limb of the core 110*b* as illustrated.

FIG. 1*c* shows a so-called 3-phase transformer 100*c*. In this type of transformer each phase has a respective primary coil 120-1, 120-2, 120-3 and a respective secondary coil 130-1, 130-2, 130-3 as illustrated. Such coils may be connected in a star form or in a delta form as is commonly known in the art.

When the demands of the transformer are higher, typically an isolation transformer is used. Isolation transformers block transmission of the DC-component in signals from one circuit to the other, while allowing AC-components in signals to pass. Transformers that have a ratio of 1-to-1 between the primary and secondary windings are often used to protect secondary circuits and individuals from electrical shocks between energized conductors and earth ground.

Figure 2A:
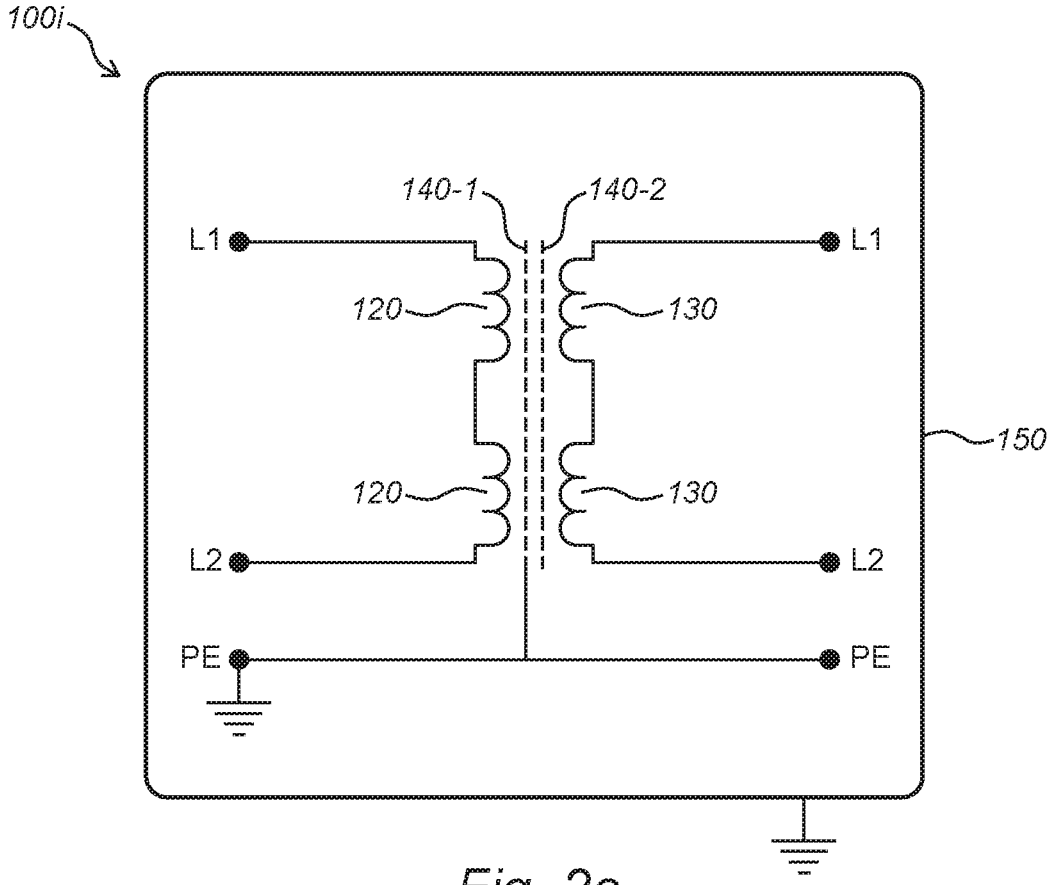

FIG. 2*a* shows a schematic of such an isolation transformer, which is a 1-phase isolation transformer 100*i* in this example. Typical for isolation transformers is that these are provided with at least one so-called electrostatic shield 140-1, 140-2 in between the primary coil 120 and the secondary coil 130 as illustrated. Both the primary coil 120 as well as the secondary coil 130 comprise effectively two coils in series in this example, which enables to have an intermediate node in between respective input/output phases L1, L2. However, this is not essential for a 1-phase transformer. In addition, such transformers are typically put in a Faraday cage 150 in order to prevent the transformer from influencing other circuits through radiation, but also to prevent other circuits from influencing said transformer. Both the Faraday cage 150 as well as the electrostatic shields are typically connected to ground PE, as illustrated.

Figure 2B:
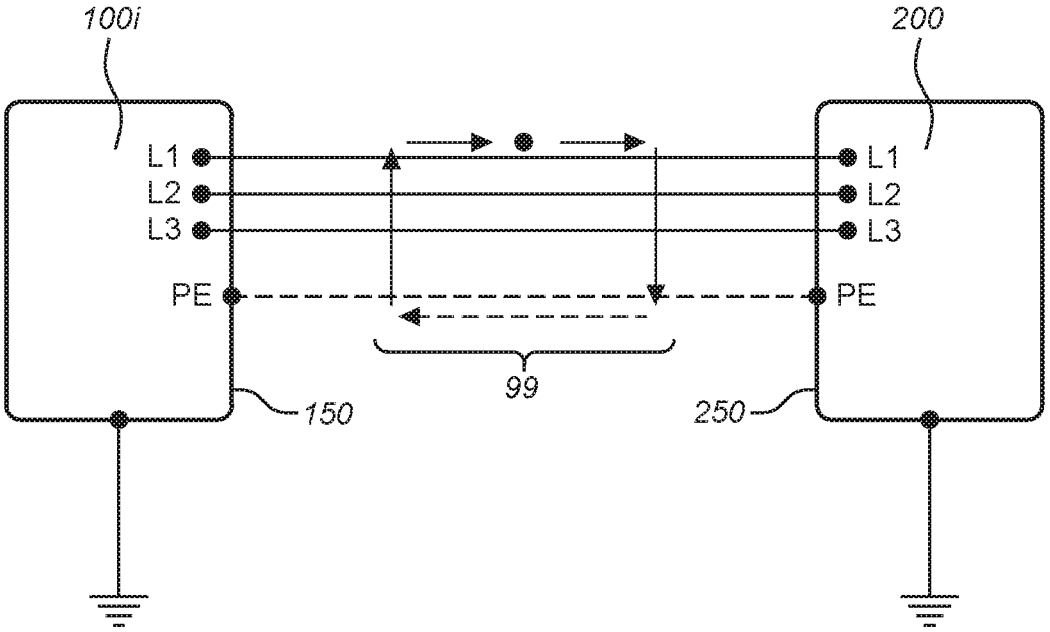

FIG. 2*b* illustrates a problem that often occurs in isolation transformers. The figure shows the isolation transformer of FIG. 2*a* (but then with 3-phases L1, L2, L3) that is now coupled to a further circuit 200 via respective cables. The further circuit is also provided in a Faraday cage 250. Suitably designed isolation transformers block interference caused by ground loops 99 as illustrated in FIG. 2*b*. Ground loops are a major cause of noise, hum, and interference in electrical systems. In an electrical system, a ground loop or earth loop is an equipment and wiring configuration in which there are multiple paths for electricity to flow to ground. The multiple paths form a loop, which pick up stray current through electromagnetic induction. This results in unwanted current in a conductor connecting two points that are supposed to be at the same electric potential, often, but are at different potentials actually. A main reason behind ground loops is that the impedance of the ground lines is too high, which is generally because of the reactive part ($\omega L$) of the impedance, which becomes dominant at higher frequencies.

A known way of tackling noise caused by EMI is to build expensive and complex filters to subdue the noise actively. The inventor realized that the problem is in fact worsened by the way isolation transformers are built and used.

The inventor realized that the problem is often caused by the fact that all ground terminals are simply connected together without people realizing that such connection worsens the amount of ground loops induced in the systems. In other words, the grounding in the traditional way of building and using isolation transformers is hardly effective, i.e. more problems are created than there are solved.

The first improvement of the current invention concerns the design of the isolation transformer. As a first step the isolation transformer of the invention is provided with a separate electrical ground node provided inside the Faraday cage at a position where the magnetic flux and electric field are substantially zero. The main idea by this separate ground node is to keep it as clean as possible, but also to keep the impedance to this separate ground node as low as possible. In case it would be placed at a location where there is significant magnetic and/or electric field, the separate electrical ground node would catch unwanted signals again (act as an antenna).

Figure 3:
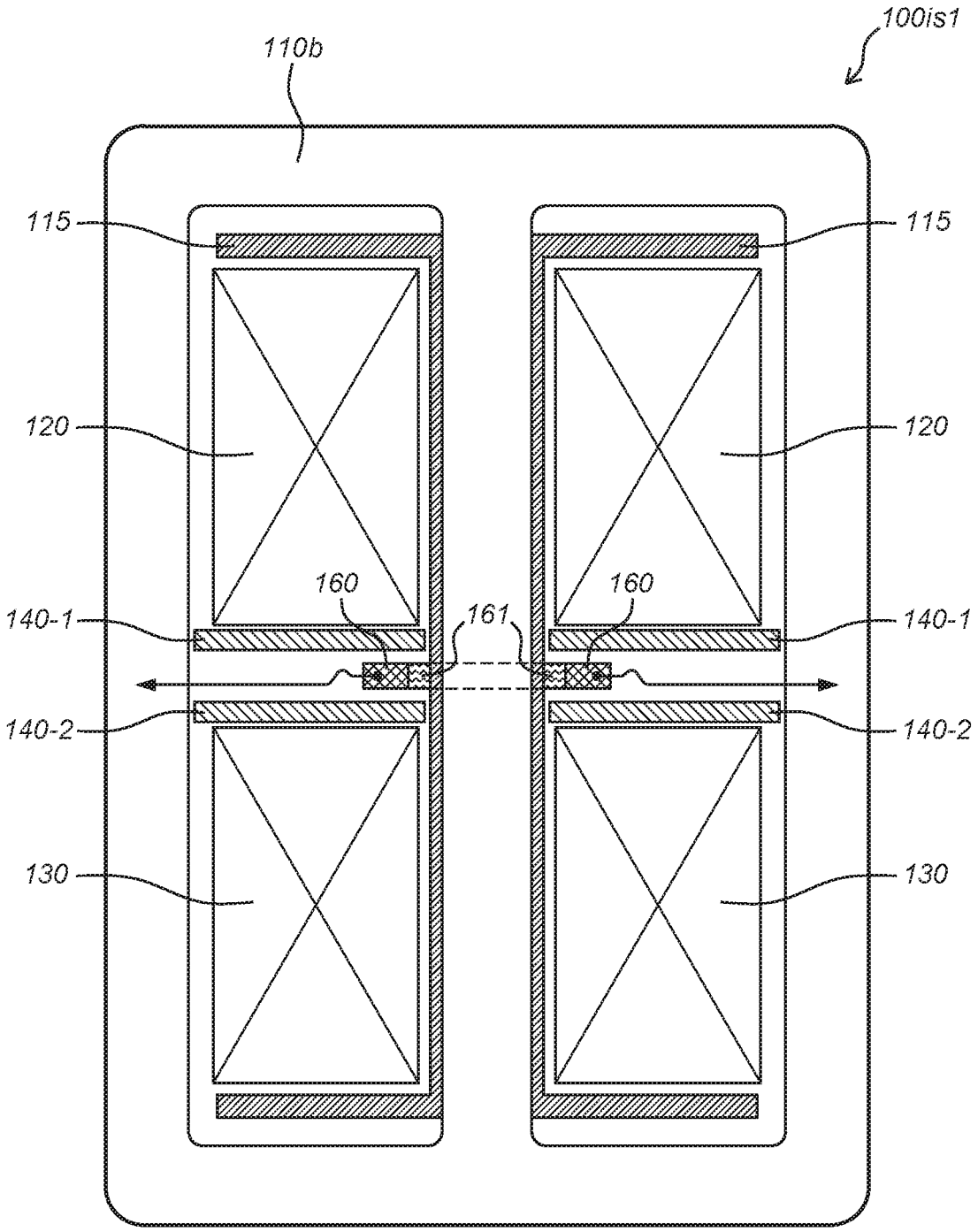
FIG. 3 illustrates a main principle of the invention in a first embodiment of the isolation transformer in accordance with the invention.

FIGS. 3-5, 6*a*-6*c* illustrate potential locations for implementing such separate electrical ground node. FIG. 3 illustrates a main principle of the invention in a first embodiment of the isolation transformer 100*is*1 in accordance with the invention. This embodiment comprises a three-limb magnetic core 110*b* as in FIG. 1*b*. The primary coil 120 and the secondary coil 130 are provided on the same limb of the magnetic core 110*b*, but axially placed with regards to each other. In between the coils and the respective limb there is also visible a bobbin 115, which serves to facilitate holding the wires of said coils 120, 130 in place. In between said primary coil 120 and said secondary coil 130 there is located two electrostatic shields 140-1, 140-2 for reducing the capacitive coupling between said coils 120, 130. In the invention, the electrostatic shields 140-1, 140-2 serve a further purpose, namely to create a place of no electric field, such that the further electrical ground node can be implemented there. In this embodiment the further electrical ground node is implemented in the form of a conductor ring 160 around said limb, placed in between said electrostatic shields 140-1, 140-2, where the electric and magnetic fields are typically the lowest. A further ring 161 made of electrically insulating material (for instance comprising Teflon) is provided in between the ring 160 and the bobbin 115. FIG.

3 further illustrates via illustrated arrows how a connection to or from the conductor ring 160 can be made, i.e. either approaching from the left side or the right side, or from or in any other radial direction in between said electrostatic shields 140-1, 140-2.

Figure 4:
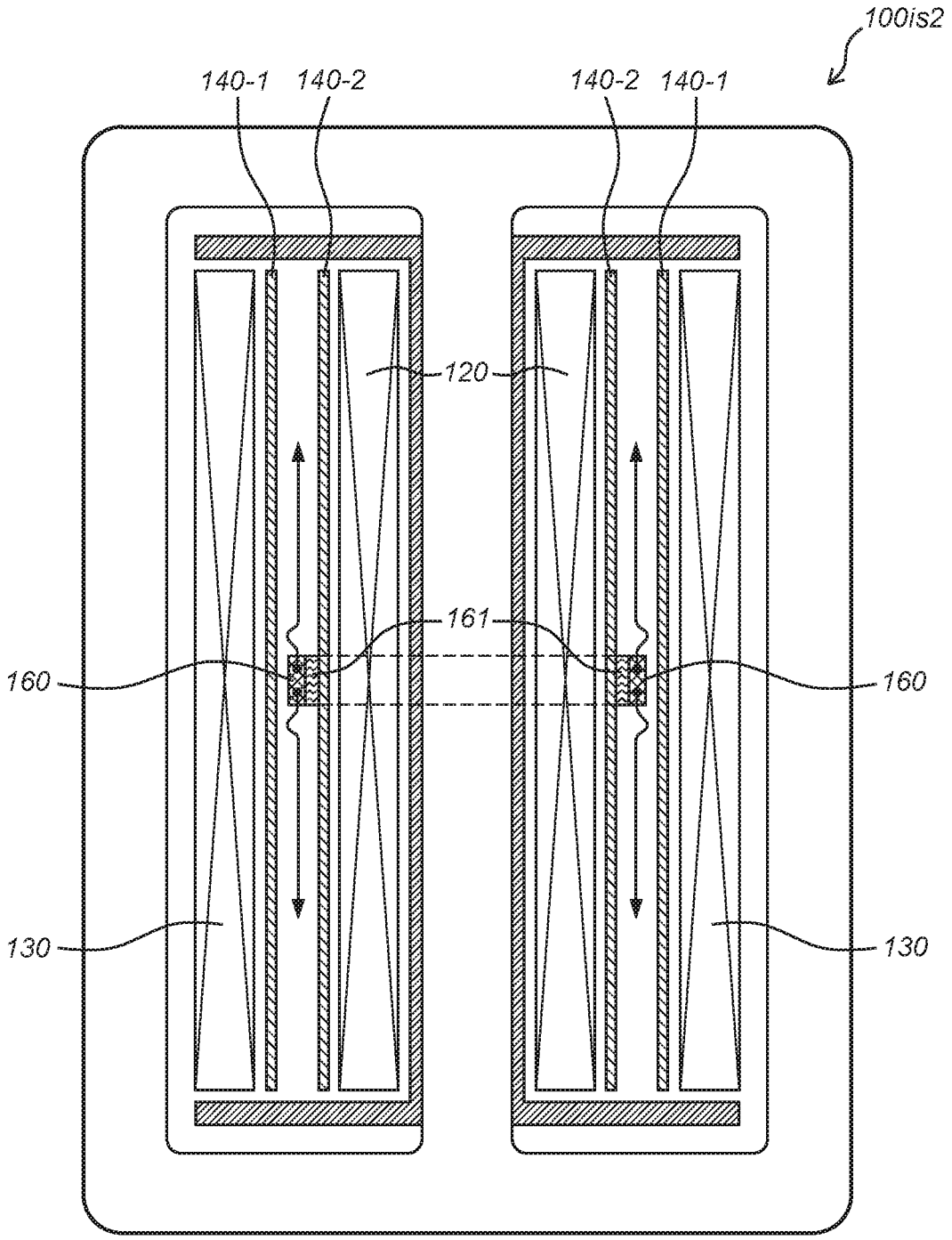
FIG. 4 illustrates the same main principle of the invention in a second embodiment of the isolation transformer in accordance with the invention.

FIG. 4 illustrates the same main principle of the invention in a second embodiment of the isolation transformer 100*is*2 in accordance with the invention. The main difference between this embodiment and the embodiment of FIG. 3 is that the primary coil 120 and the secondary coil 130 are placed concentric with respect to each other. Furthermore, the electrostatic shields 140-1, 140-2 are placed as two cylindrical concentrically placed elements in between said concentrically placed coils 120, 130, as illustrated. The further electrical ground node in this embodiment is provided as a conductor ring 160 in between said electrostatic shields 140-1, 140-2, where the electric and magnetic fields are typically the lowest. FIG. 4 also illustrates that the connection to or from this conductor ring 160 is now to be done in the axial direction of said coils as illustrated by the arrows.

Figure 5:
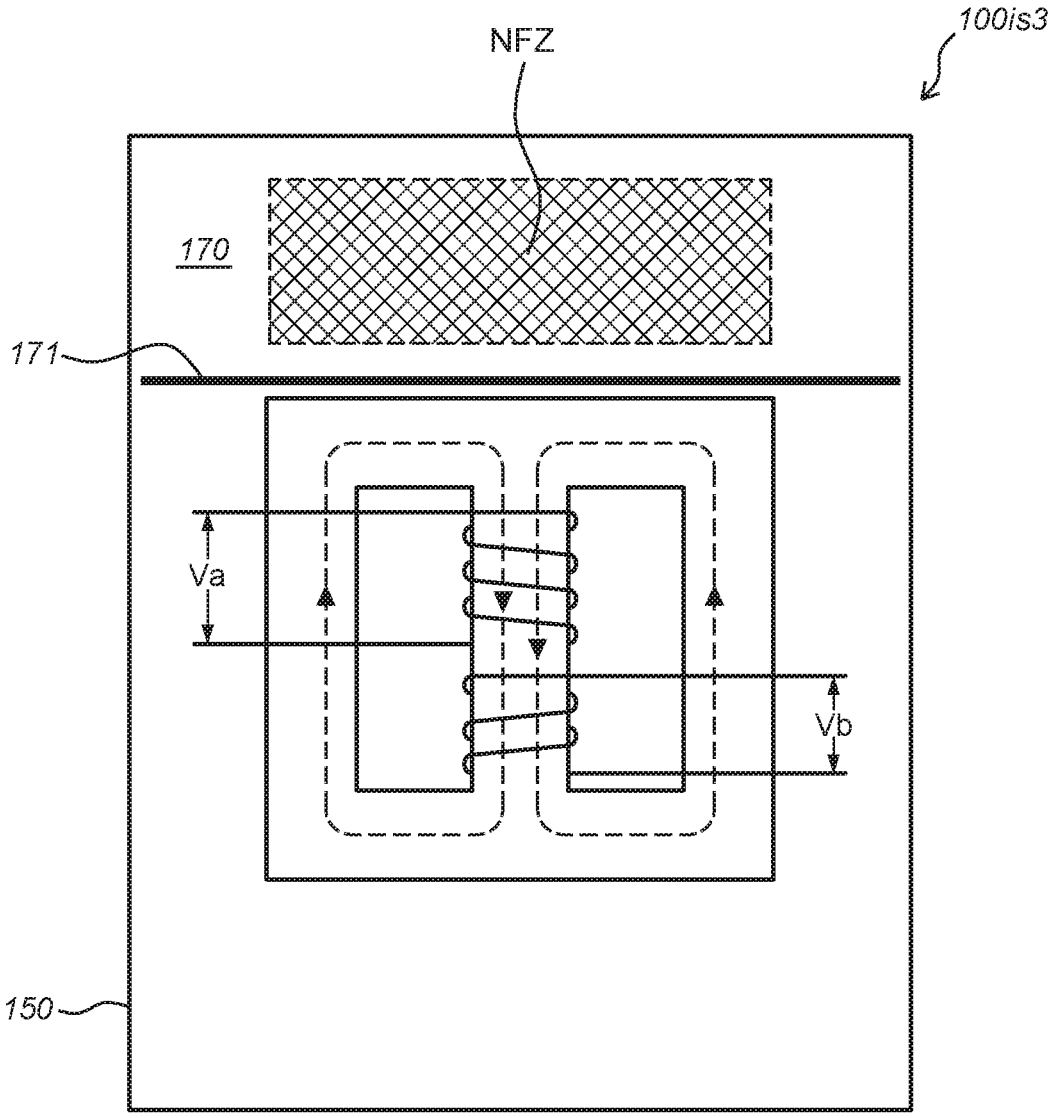
FIG. 5 illustrates the same main principle of the invention in a third embodiment of the isolation transformer in accordance with the invention.

The embodiments of the isolation transformer 100*is*1, 100*is*2 as shown in FIG. 3 and FIG. 4 may be challenging in terms of connecting the further electrical ground. The embodiment of FIG. 5 provides an alternative solution, which may be easier to manufacture. FIG. 5 does illustrate the same main principle of the invention in a third embodiment of the isolation transformer 100*is*3 in accordance with the invention, yet it achieves this in a slightly different way. Instead of providing the further electrical ground node in between said coils, it is now implemented in a further Faraday cage 170 that is manufactured inside the Faraday cage 150 of the isolation transformer 100*is*3. By implementing this further Faraday cage 170, a so-called no-field zone NFZ (or low-field zone) can be established, even if the transformer itself creates a certain electrical and magnetic field. Instead of making a fully enclosed Faraday cage it may suffice to only implement a Faraday shield 171 inside the Faraday cage 150 thus effectively defining the further Faraday cage 170. Inside the no-field zone NFZ the earlier mentioned further electrical ground node can be implemented.

FIGS. 6*a*-6*c* illustrate possible no-field zones (or low-field zones) in the examples of FIGS. 1*a*-1*c*. In each of the examples the no-field zones (or low-field zones) are formed in between said two-electrostatic shields 140-1, 140-2 (meaning substantially no electric field) and outside the respective magnetic cores 110*a*, 110*b*, 110*c* (meaning substantially no magnetic field).

FIG. 7 shows a more detailed schematic of a fourth embodiment of the isolation transformer 100*is*4 in accordance with the invention. The isolation transformer 100*is*4 is a three-phase transformer having three input terminals Ti1, Ti2, Ti3 that are fed via respective input wires i1, i2, i3 via a first isolated junction box 180 to respective primary coils 120-1, 120-2, 120-3 that are connected in a star network in this embodiment. The secondary coils 130-1, 130-2, 130-3 are connected to respective output terminals To1, To2, To3 via respective output wires o1, o2, o3 via a second isolated junction box 181. Furthermore, there is a Faraday cage 150 as illustrated, which is connected to the input ground terminal GT1 (and thus to ground PE). The Faraday cage 150 is also connected to the electrostatic shields 140-1, 140-2 and further to the ground output terminal GT2 to be connected to further circuits. So far, all mentioned parts in FIG. 7 are conventional for isolation transformers.

What renders the isolation transformer 100*is*4 of FIG. 7 special is that there is provided a physical electrical node 175 inside a further Faraday cage 170 (defining the earlier discussed no-field (or low-field) zone NFZ) within the Faraday cage 150 that is defined by a Faraday shield 171 as illustrated. The physical electrical node 175 is connected to a clean ground input terminal 181 via a first electric connection 185 (for instance a double isolated cable, which is typically used before the earth-leakage circuit breaker in an electric system of a house-hold). The physical electrical node 175 is further connected to a clean ground output terminal 199 via a second electric connection 195. The second electric connection 195 in this embodiment constitutes a twisted-pair shielded cable comprising two wires 196 that are intertwined as illustrated. Each of said wires 196 is connected to the physical electrical node 175 and fed to the clean ground output terminal 199 as illustrated. In FIG. 7 the second electric connection 195 is drawn as running parallel with and in between said electrostatic shields 140-1, 140-2, but that is not essential. In fact, the second electric connection 195 may alternatively be fed out of the isolation transformer 100*is*4 parallel to said output wires o1, o2, o3 for instance. This offers the option to combine said wires into a multi-core shielded cable as will be discussed with reference to FIGS. 8*a* and 8*b*. What is important in the invention is that EMI is reduced by designing said electric connections such that as little magnetic and electric field is met as possible or at least minimize (or cancel) this effect by using special cables and/or carefully placing said cables such that EMI is reduced.

FIG. 7 further illustrates a sensor and controller circuit 190 (CPU) that is configured for measuring noise on said inputs and outputs as illustrated by the arrows and eventually controlling the position of said physical electrical node 175 to minimize the electric field and magnetic fields experienced by this node for reducing/minimizing the noise. In the embodiment of FIG. 7 the position of said physical electrical node 175 is controllable as illustrated by said arrows.

FIGS. 8*a*-8*b* show a multi-core shielded cable 300 in accordance with a further embodiment of the invention. As already discussed with reference to FIG. 7 the invention aims at reducing induced noise (EMI) by minimizing or cancelling electric and magnetic fields to which cables and wires in the isolation transformer are exposed. FIG. 8 shows a special cable that has been developed by the inventor to further improve the performance of the isolation transformer. The multi-core shielded cable 800 effectively comprises two cables (a first core 311 and a second core 321) combined into one cable sleeve 301 as FIGS. 8*a* and 8*b* illustrate. The cable sleeve 301 may comprise oil-resistance PVC for example. The first core 311 is in fact the earlier-discussed second electric connection 195. The second core 321 comprises the output wires o1, o2, o3 each carrying a respective output phase/signal L1, L2, L3 as discussed above view of FIG. 7. Both the first core 311 as well as the second core 321 comprise a shield that eventually is connected to ground (PE).

FIG. 9 shows a problem that may occur in isolation transformers of the prior art. The figure shows an application of an isolation transformer as known from the prior art. There is shown a power unit 100*pi*, which includes an isolation transformer as known from the prior art. The power unit 100*pi* connected to a motor 500 via a cable 400 (i.e. a 3×2.5 mm RFOU cable). The motor 500 is mechanically (but thereby also electrically) connected to a gear 700 via a motor shaft 600. Due to the impedances (resistance and reactance) in the ground connections being so high, any high-frequency circulating current (noise) 501 generated in the motor 500 will choose the lowest impedance path through the motor shaft 600 resulting in an undesired shaft grounding current 601. This current 601 can be as high as 50 Ampére and goes through the shaft bearings and the gear. The bearings are heated and the grease disappears, resulting in bearing construction failure.

FIG. 10*a* shows the same application as FIG. 9, but now using an isolation transformer in accordance with the invention. The figure is a bit simplified compared to FIG. 9. There is shown a mains supply (3-phase) 99 that is connected to an isolation transformer 100*is*4 in accordance with the invention (for instance the one shown in FIG. 7). The isolation transformer 100*is*4 is connected to the motor, shaft and gear assembly 500, 600, 700 as shown in FIG. 9 via the special cable 300 shown in FIGS. 8*a* and 8*b*. The isolation transformer 100*is*4 receives its clean ground from an external clean ground terminal (not shown).

FIG. 10*b* shows how the isolation transformer of the invention solves the problem that occurs in FIG. 9*b*. In this somewhat simplified figure, the isolation transformer 100*is*4 forms a power unit 100*pis* together with the mains connection 99. Due to the impedances (resistance and reactance) in the ground connections being now much lower, any high-frequency circulating current (noise) 501 generated in the motor 500 will choose the lowest impedance path through the multi-core shielded cable 300 and result in a return current 301 in that cable 300.

The particular embodiments disclosed above are illustrative only, as the invention may be modified and practiced in different but equivalent manners apparent to those skilled in the art having the benefit of the teachings herein. For example, the method steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope of the invention. Accordingly, the protection sought herein is as set forth in the claims below.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. The mere fact that certain measures are recited in mutually different dependent claims does not indicate that a combination of these measures cannot be used to advantage. In the device claim enumerating several means, several of these means may be embodied by one and the same item of hardware.

The invention claimed is:

1. An isolation transformer configured for connecting to an external clean ground and to a further clean ground input terminal of a further circuit, the isolation transformer comprising:

a Faraday cage comprising a magnetic core and at least one primary coil and at least one secondary coil;

input terminals connected to the at least one primary coil via input wires;

output terminals connected to the at least one secondary coil via output wires; and an input ground terminal for connecting to the Faraday cage and an output ground terminal connected to the Faraday cage, the output ground terminal being configured for connecting to the further circuit;

wherein the isolation transformer further comprises:

a clean ground input terminal for connecting to the external clean ground;

a clean ground output terminal for connecting to the further clean ground input terminal of the further circuit; and a physical electrical node placed at a location within the Faraday cage where the magnetic flux and electric field are the lowest;

wherein the clean ground input terminal is electrically fed into the isolation transformer and connected to the physical electrical node through a first electric connection; and wherein the physical electrical node is further electrically connected to the clean ground output terminal through a second electric connection.

2. The isolation transformer according to claim 1, wherein the second electric connection comprises a twisted-pair shielded cable, wherein both wires of the cable are connected both to the physical electrical node and to the clean ground output terminal.

3. The isolation transformer according to claim 2, wherein the twisted-pair shielded cable is placed such that it runs parallel over a certain length with signal carrying wires connected between the at least one secondary coil and the output terminals.

4. The isolation transformer according to claim 2, wherein the output wires comprise a twisted-core shielded cable, wherein all output signals are intertwined within the shielded cable for reducing EMI.

5. The isolation transformer according to claim 4, wherein the twisted-pair shielded cable for the clean ground and the twisted-core shielded cable for the output signals are, at least over a certain length, combined into a multi-core shielded cable comprising the shields of the shielded cables with their twisted wires inside of them.

6. The isolation transformer according to claim 1, wherein the location of the physical electrical node within the Faraday cage is adjustable for minimizing noise on the output terminals.

7. The isolation transformer according to claim 6, wherein the isolation transformer is provided with a sensor for sensing the noise on the output terminals, in operational use, and wherein the isolation transformer is configured for automatically adjusting, in operational use, the location of the physical electrical node in response to the sensed noise on the output terminals.

8. The isolation transformer according to claim 1, wherein at least two separated electrostatic shields are placed in between each pair of primary coil and corresponding secondary coil.

9. The isolation transformer according to claim 8, wherein the physical electrical node is formed in between one of the at least one primary coil and the corresponding secondary coil, in between the electrostatic shields and outside the magnetic core.

10. The isolation transformer according to claim 9, wherein the physical electrical node comprises a conductor that is mounted on the magnetic core via a dielectric barrier.

11. The isolation transformer according to claim 8, wherein the physical electrical node is formed in a further Faraday cage formed inside the isolation transformer.

12. The isolation transformer according to claim 1, wherein the magnetic core comprises a five-limb magnetic core.

13. The isolation transformer according to claim 1, comprising two primary coils and two secondary coils, wherein the input terminals receive at least two input phase signals in operational use, and wherein the output terminals generate at least two output phase signals in operational use.

14. The isolation transformer according to claim 1, comprising three primary coils and three secondary coils, and wherein the input terminals receive at least three phase signals in operational use, and wherein the output terminals generate at least three phase signals) in operational use.

15. The isolation transformer according to claim 1, wherein the input ground terminal is connected to the at least one primary coil.

* * * * *